US005099291A

United States Patent [19]

Yoshioka et al.

[11] Patent Number: 5,099,291

[45] Date of Patent: Mar. 24, 1992

[54] TRANSPORTING APPARATUS FOR SHEETS OF ORIGINAL AND RECORDING-SHEET SUPPLYING APPARATUS

[75] Inventors: Yoshiki Yoshioka, Kyoto; Masami Yamada, Osaka; Hiroyuki Tsuji, Kyoto; Tadashi Fujioka, Toyonaka; Koji Ujino, Osaka, all of Japan

[73] Assignee: Mita Industrial Co., Ltd., Osaka, Japan

[21] Appl. No.: 611,054

[22] Filed: Nov. 9, 1990

[30] Foreign Application Priority Data

Nov. 13, 1989 [JP] Japan ..... 1-294155
Nov. 28, 1989 [JP] Japan ..... 1-310409

[51] Int. Cl.[5] ..... G03G 21/00

[52] U.S. Cl. ..... 355/316; 271/265; 355/308

[58] Field of Search ..... 355/316, 317, 321, 233, 355/235, 308, 309, 314, 208, 204, 205; 271/3.1, 258, 265

[56] References Cited

U.S. PATENT DOCUMENTS 4,332,462 6/1982 Yagasaki et al. ..... 271/258 X
4,939,554 7/1990 Hirabayashi et al. ..... 355/317

*Primary Examiner*—A. T. Grimley
*Assistant Examiner*—Christopher Horgen
*Attorney, Agent, or Firm*—Beveridge, DeGrandi & Weilacher

[57] ABSTRACT

An image forming apparatus which has a contact glass, an original transporting part for transporting a sheet of original onto the contact glass, an optical exposure system for scanning the sheet of original placed on the contact glass by reciprocating movement below the contact glass, an image forming part for forming an image of the original obtained by the optical exposure system on a recording sheet, and a part for supplying the recording sheet to the image forming part. The original transporting part comprises an original storing part for storing sheets of original; means for transporting a sheet of original from the original storing part onto the contact glass; means for detecting the passage of the sheet of original, provided in the sheet transporting means; and means for outputting an original-exchange completion signal to the image forming apparatus after the passage detecting means detects the passage of the sheet of original and before the sheet transporting means positions the sheet of original onto a predetermined portion of said contact glass. The recording-sheet supply part comprises means for judging whether a next sheet of original to be transported to the contact glass exists; means for transporting a recording sheet to the image forming part; and means for controlling the transporting means whereby the recording sheet transporting means is begun before the optical exposure system starts to return, if a next sheet of original exists.

14 Claims, 5 Drawing Sheets

TRANSPORTING APPARATUS FOR SHEETS OF ORIGINAL AND RECORDING-SHEET SUPPLYING APPARATUS

BACKGROUND OF THE INVENTION

The present invention relates to an apparatus for transporting sheets of original and an apparatus for supplying recording sheets. More specifically, it relates to an apparatus for transporting a sheet of original to a predetermined portion of a contact glass in an image forming apparatus, and an apparatus for supplying a recording sheet on which an image of the original is formed.

TRANSPORTATION OF ORIGINALS

An image forming apparatus such as a copying machine has an automatic document feeder (referred to as ADF below) in its upper portion. The ADF has an original storing part for storing originals; transporting means for transporting sheets of original from the original storing part to a predetermined portion of the contact glass of the copying machine, and for discharging the sheet from the contact glass; and an original receiving part for receiving the discharged sheet.

A copying machine with an ADF as above is disclosed in, for example, Japanese Patent Laying-Open No. 285533/1988. In this copying machine, when the print key is pressed, the control unit of the copying machine outputs a signal to a control unit of the ADF whereupon the ADF starts to position a sheet of original. Having received the signal, the control unit of the ADF causes a motor in the transporting means to rotate, whereby a sheet of original is transported to a predetermined portion of the contact glass. Subsequently, the ADF discharges the positioned sheet, and transports the next sheet of original onto the contact glass. While a sheet of original is being supplied to the contact glass, the control unit continually monitors a signal which is generated by a jam-detecting switch located in the sheet transportation path. When the jam-detecting switch detects the passage of a sheet, a timer begins. When the timer expires, the control unit causes the motor in the transporting means to stop. Subsequently, the control unit outputs a signal which indicates to the control unit of the copying machine that the operation which exchanges sheets of original is completed.

Having received the original-exchange signal from the ADF, the copying machine prepares for the copying process. More specifically, the copying machine determines whether the optical system is located at its home position, whether a sheet of recording paper has reached the resist rollers, and whether toner concentration is normal. Then the machine begins the copying process.

Thus, a conventional copying machine having an ADF as above must make a number of determinations in the period between the time the original-exchange signal is received, and the copying processes is begun. Consequently copying speed is slow, since the copying process cannot be initiated for a moment, even though the exchange of originals has been completed.

SUPPLYING RECORDING PAPER

As a sheet of original is set in a predetermined position onto the contact glass in the above manner, one of the paper cassette cases, corresponding to the size of the original, is selected, and then a sheet of recording paper is supplied from the paper cassette case to the image forming part of the copying machine. The control unit of the copying machine determines whether the sheet has reached the resist rollers. When the sheet is detected at the resist rollers, the optical exposure system starts to scan the original, and the resist rollers allow the sheet of recording paper to move toward the image forming part. Then, the image forming part carries out its copying process. Subsequently, when the control unit detects that the optical exposure system has started to return, the control unit determines whether a next sheet of original to be positioned onto the contact glass exists. If it is the case that a next sheet of original exists, the control unit actuates the ADF to exchange the original sheets in the same manner as in the above, whereby the sheet of original which has been processed for obtaining a copy is discharged, and the next sheet of original is positioned onto the predetermined portion of the contact glass. Then a sheet of recording paper is supplied from a paper cassette case. When the control unit detects that the optical exposure system is located at its home position, the control unit determines whether a sheet of recording paper has reached the resist rollers. After detecting that a sheet of recording paper is located at the resist rollers, the optical exposure system begins to scan the original, and the process which follows is executed.

A copying machine may have a plurality of paths for supplying sheets of recording paper, that is, paper cassette cases of various paper sizes and a bypass tray may be provided in the copying machine. Each of these paths is different in length between the paper-supplying parts and the resist rollers. Additionally, the distance between a paper-supplying part and the resist rollers the copying machine may be long, wherein a sheet of recording paper can not reach the resist rollers before the optical exposure system arrives at the home position and a sheet of original is positioned onto the contact glass. In this case, since the copying process which follows cannot start until the sheet of recording paper has reached the resist rollers, the copying machine must wait momentarily, whereby overall copying speed is delayed.

SUMMARY OF THE INVENTION

It is an object of the present invention to provide an apparatus for transporting sheets of original which reduces time waste between the completion of exchange of originals and the subsequent start of image formation.

It is another object of the present invention to provide an apparatus for transporting sheets of original which is able to regulate the timing at which an original-exchange completion signal is outputted.

It is yet another object of the present invention to provide an apparatus for supplying a recording sheet which performs at increased speed, due to a reduction in waste time following the completion of an original exchange.

It is a further object of the present invention to provide an image forming apparatus wherein the total operation time to process a plurality of original sheets for image forming is reduced.

(1) An apparatus for transporting sheets of original according to the present invention places a sheet of original onto a predetermined portion of a contact glass in an image forming apparatus, and discharges the sheet of original from the contact glass to an original receiving part. It comprises a part for storing the original, means for transporting a sheet of original from the original storing part, means for detecting the passage of the sheet of original, and means for outputting an original exchange completion signal.

The detecting means is provided in the transporting means to detect the passage of a sheet of original transported toward the contact glass. The signal-output means outputs the exchange signal after the detecting means detects the passage of a sheet of original transported toward the contact glass and before the sheet of original arrives at the predetermined portion of the contact glass.

This apparatus starts exchanging sheets of original when it receives a command to exchange sheets from the control unit of the image forming apparatus, and then it outputs an original-exchange completion signal to the control unit. In the process, the detecting means detects the passage of a sheet of original. Following detection, the signal-output means outputs a sheet exchange completion signal to the control unit of the image forming apparatus before the detected sheet of original has been located onto the predetermined portion of the contact glass.

Accordingly, the subsequent processes of the image forming apparatus are begun earlier than they may be in conventional apparatuses which receive the sheet-exchange completion signal after the sheet exchange has actually been completed. Thus, a plurality of sheets of original can be processed in reduced time.

(2) According to another aspect of the present invention, an apparatus for supplying a recording sheet is provided in an image forming apparatus which comprises an apparatus for transporting a sheet of original onto a contact glass, an optical exposure system for scanning the sheet of original on the contact glass by its reciprocating movement below the contact glass, and an image forming system for transferring an image of the original onto a recording sheet. The recording-sheet supply apparatus comprises means for detecting a next sheet of original, transporting means and controlling means.

The next-sheet detecting means detects the presence of a next sheet of original to be transported to the contact glass. The transporting means supplies a recording sheet to the image forming system. The controlling means controls the transporting means such that the transporting means begins to supply a recording sheet before the optical system begins to return, if a next sheet of original is detected by the next-sheet detecting means.

In the apparatus, whether a next sheet of original to be transported exists or not is determined accordingly to a signal from the original transporting apparatus. If a next sheet of original exists, the apparatus starts to supply the next recording sheet before the optical exposure system begins to return. Consequently, wait time for the next recording sheet vanishes, or is reduced, relative to that of conventional apparatuses, whereby image forming operation corresponding to a plurality of original sheets may be executed at high-speed.

The next recording sheet may begin to be fed at the time when the scanning of a sheet of original on the contact glass begins, that is, when the prior recording sheet is released from the resist rollers.

These and other objects and advantages of the present invention will be more fully apparent from the following detailed description.

DESCRIPTION OF THE PREFERRED EMBODIMENT

Figure 1:
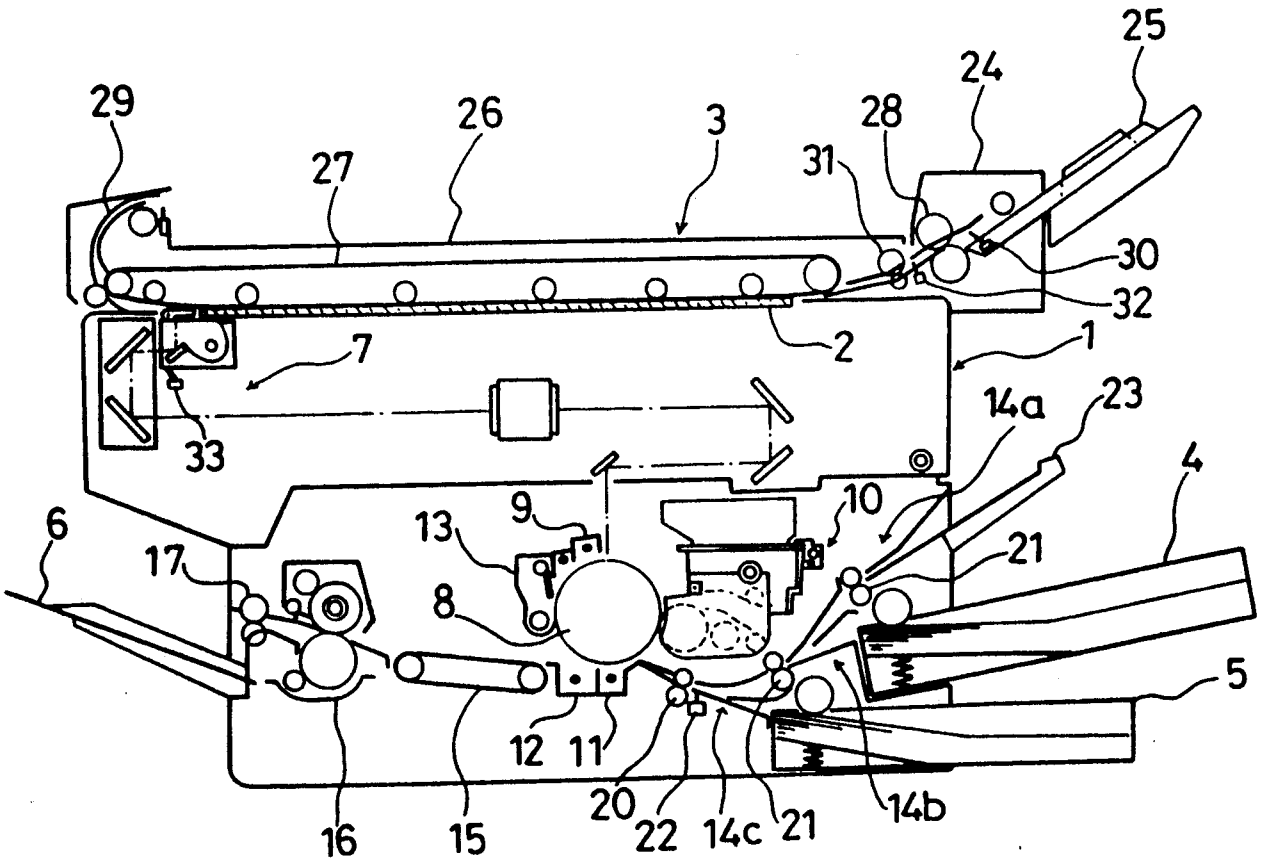
FIG. 1 is a schematic sectional view showing a copying machine including an embodiment according to the present invention.

FIG. 1 shows a copying machine as an image forming apparatus including an embodiment of the present invention.

Referring to FIG. 1, a main copying machine part 1 has a contact glass 2 in the upper surface and an ADF 3 thereon. On the right side of the main part 1 in the figure, a bypass tray 23 and detachable paper cassette cases 4 and 5 are attached. On the left side of the main part 1, a copy tray 6 is attached wherein copied paper is received.

In the upper portion of the main part 1, an optical exposure system 7 for obtaining information from the original image is located. The optical exposure system 7 consists of a light source, mirrors, a lens unit, etc. Provided at the home position of the exposure system 7 is a home position switch 33 which detects the exposure system 7 when located at the home position. In the central portion of the main part 1, a photoconductive drum 8 is disposed on which an electrostatic latent image is formed. Surrounding the photoconductive drum 8 a charging device 9, a developing device 10, a transferring device 11, a detaching device 12, and a cleaning device 13 are provided.

Between the bypass tray 23 and the image forming part composed of the photoconductive drum 8, etc.; the paper cassette case 4 and the image forming part; and the paper cassette case 5 and the image forming part; paper transporting paths **14*a*, 14*b* and 14*c*, respectively, are provided for supplying recording sheets to the image forming part. A discharging unit 15 for discharging the recording paper, a fixing unit 16 for fixing a transferred image onto the recording paper, and rollers 17** for discharging the recording paper are also provided.

Each of the paper transporting paths **14*a* to 14*c* is primarily composed of pairs of plate-like members with a gap therebetween. In the paper transporting paths 14*a* to 14*c*, the path 14*a* from the bypass tray 23 is longest, the path 14*b* from the paper cassette case 4 is second longest, and the path 14*c* from the paper cassette case 5 is shortest. Provided at the end of the paper transporting paths 14*a* to 14*c* near transferring device 11 are a pair of resist rollers 20 for transporting sheets of recording paper at a predetermined timing to the image forming part. In a portion of the paper stream back from the resist rollers 20, a resist-roller switch 22 is provided for detecting whether a sheet of recording paper has reached the resist rollers 20. Each of two pairs of transporting rollers 21 is provided in the paper transporting paths 14*a* and 14*b* between the resist rollers 20 and the bypass tray 23**.

The ADF 3 has a housing 24, an original storing tray 25 attached on the right side of the housing 24, and an original receiving part 26 formed in the upper central portion of the housing 24. A plurality of rollers are disposed with lateral spacing below the original receiving part 26 in the housing 24. A transportation belt 27 is fitted onto the rollers. The bottom surface of the transportation belt 27 is located against the contact glass 2. A pair of transporting rollers 28 for transporting sheets of original from the original storing tray 25 sheet by sheet toward the transporting belt 27 are provided in the right side-portion of the housing 24. In a part of the sheet stream ahead of the transporting rollers 28, a pair of resist rollers 31 is located. A switch 32 which can detect jamming of the original sheets in the original transporting path is provided adjacent to the resist rollers 31 and between the resist rollers 31 and the transporting rollers 28. A switch 30 for detecting whether there is a next sheet of original to be transported onto the contact glass 2 is provided in the bottom end-portion of the original storing tray 25 adjacent to the transporting rollers 28. In the left side-portion of the housing 24, an original-discharging path 29 is provided, through which a sheet of original is discharged from the transporting belt 27 to the original-receiving part 26.

Figure 2:
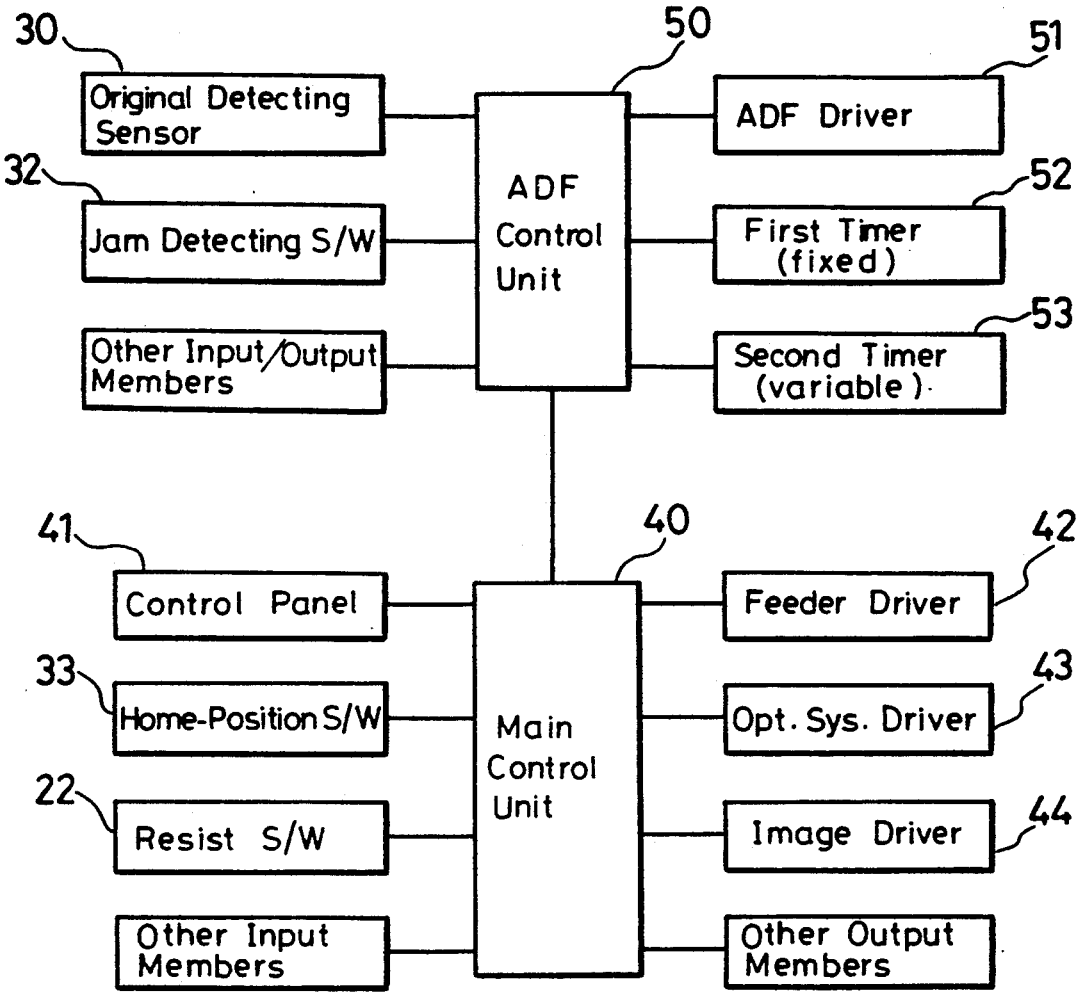
FIG. 2 is a block diagram showing control units of the copying machine.

Referring to FIG. 2, the copying machine includes a main control unit 40, which has a microcomputer composed of a CPU, a RAM, a ROM, etc. The main control unit 40 is connected with a control panel 41 located in the upper surface of the copying machine, the home position switch 33 and the resist-roller switch 22 shown in FIG. 1, and other input members. Furthermore, the main control unit 40 is connected with a feeder driver 42 for driving the rollers 21, etc., an optical system driver 43 for driving the optical exposure system 7, an image driver 44 for driving the image forming part including the developing device 10, and other output members.

The ADF 3 includes an ADF control unit 50 which has a microcomputer composed of a CPU, a ROM, a ROM, etc. The ADF control unit 50 is connected with the main control unit 40; and it is connected with the original-detecting switch 30 and the jam-detecting switch 32 shown in FIG. 1, and other input and output members. Furthermore, the ADF control unit 50 is connected with an ADF driver 51 for driving the transportation belt 27 and the transporting rollers 28, a first timer 52 used for stopping the ADF driver 51, and a second timer 53 used for regulating the timing of the output signal which indicates that an original-exchange operation is completed. The first timer 52 has a fixed expiring time, and the second timer 53 has a variable expiring time.

The operation of the above embodiment will be described with the flowcharts shown in FIGS. 3A to 3C.

Figure 3A:
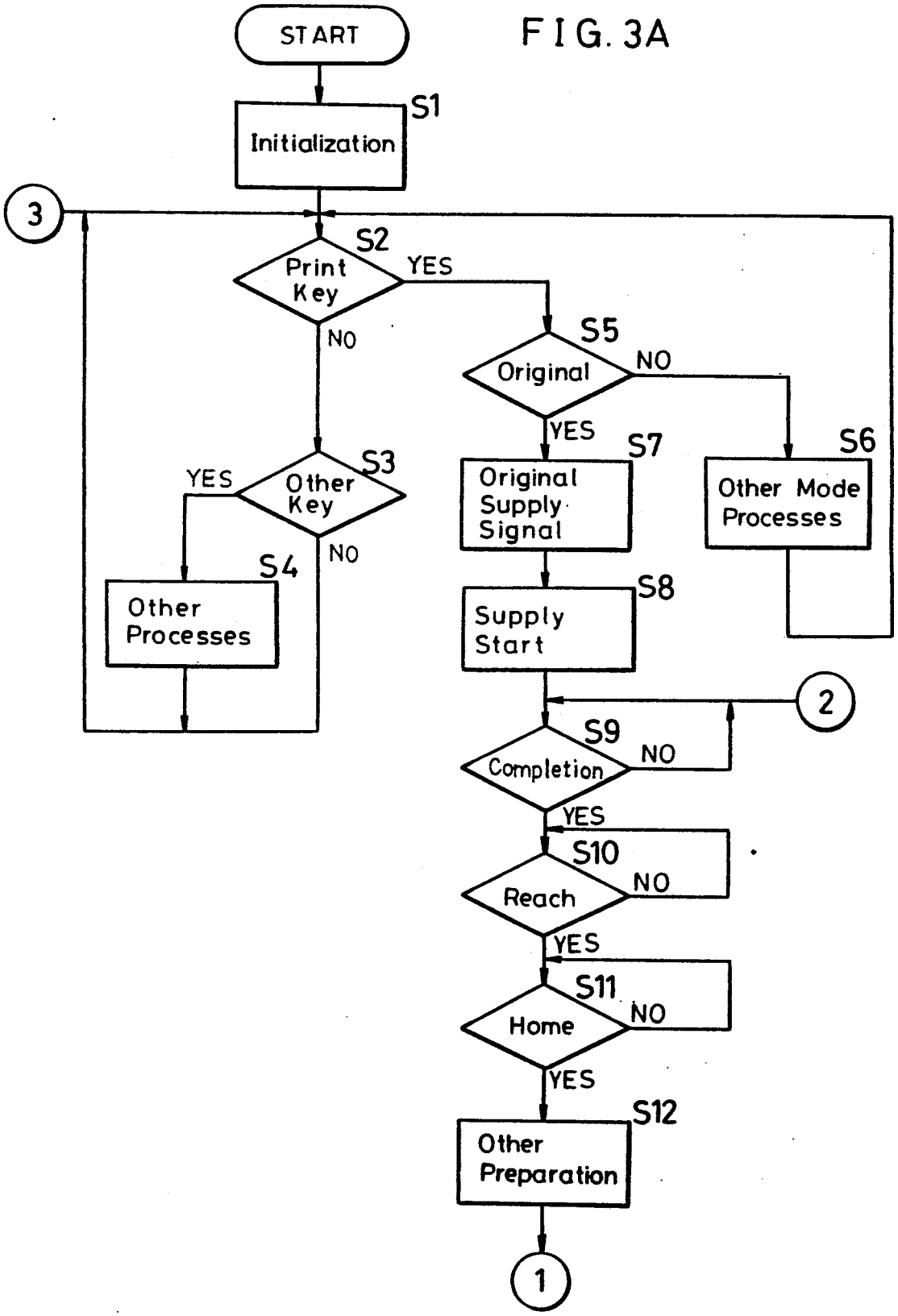
FIGS. 3A to 3C are flowcharts showing control in the embodiment.
Figure 3B:
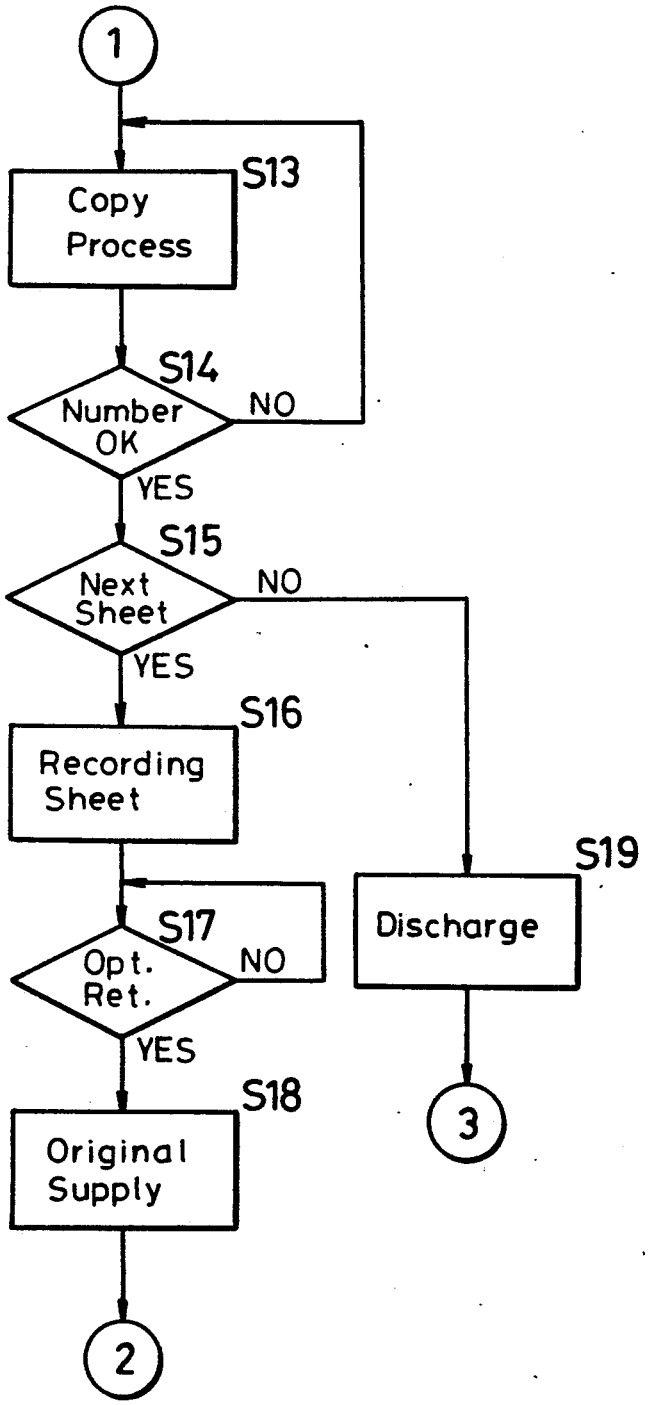

As the main switch (not shown) of the copying machine is turned on, initialization, which includes setting the number of copies at "1", is carried out at step S1 in FIG. 3A. Subsequently, it is determined at step S2 whether the print key has been pressed. If the print key has not been pressed, then it is determined at step S3 whether any one of the other keys has been pressed. If the key for setting the number of copies, selecting a copy mode, or a similar key has been pressed, the program runs from step S3 to step S4, and a process corresponding to the pressed key is carried out. Thereafter, the program runs back to step S2.

In the case wherein the print key is pressed, the program runs from step S3 to step S5. At step S5, the original detecting switch 30 determines whether an original is placed in the original storing tray 25. If an original does not exist in the original storing tray 25, step S6 is executed in order to carry out copying processes in another mode, and thereafter the program runs back to step S2.

If an original exists in the original storing tray 25 at step 5, the program proceeds with step S7. In step S7, a signal for transporting a sheet of original onto the contact glass 2 is outputted to the ADF control unit 40. In response to the signal, the ADF control unit 40 carries out the control processes shown in FIG. 3C, as described below, whereby the transporting rollers 28 and the transporting belt 27 are driven to position a sheet of original onto the predetermined portion of the contact glass 2. Just after the signal for supplying the original is outputted, the supplying of a sheet of recording paper is begun at step S8. After the execution of step S8, the transportation of a sheet of recording paper occurs. When the resist-roller switch 22 is switched by the transported sheet, the transportation is stopped after a predetermined interval in order to locate the leading edge of the sheet on the resist rollers 20.

At step S9, the program awaits the original-transfer completion signal (described below) to be outputted from the ADF control unit 40. When the signal is received at step S9, preparation processes prior to the copying processes are carried out. That is, at step S10, it is determined whether the sheet of the recording paper has reached the resist rollers 20. If the sheet has reached them, it is determined at step S11 whether the optical exposure system 7 is located at its home position. If the system 7 is at its home position, the remaining preparation processes are carried out at step S12. The determination at step S10 depends therein upon the resist-roller switch 22, and likewise the determination at step S11 depends upon the home position switch 33. After the preparation processes have all been completed, the program runs to step S13 in FIG. 3B.

At step S13, the copying processes start. That is, the optical exposure system 7 starts scanning the original, and the resist rollers 20 start rotating in order to release the sheet of recording paper and to transport it to the image forming part. At step S14, it is determined whether the processes at step S13 have been carried out with regard to the number of copies commanded. If the determination at step S14 is YES, step S15 is executed.

At step S15, the original-detecting switch 30 determines whether a next sheet of original exists in the original storing tray 25. If it does exist, step S16 is executed. In step S16, the members for supplying a sheet of recording paper are driven, in the same manner as in step 8, in order to supply another sheet of recording paper for the next sheet of original. Specifically, if there is a next sheet of original, a corresponding sheet of recording paper begins to be supplied at the timing when the former sheet of recording paper is released from the resist rollers 20 after the optical exposure system 7 starts scanning the sheet of original which is on the contact glass 2.

At step S17, it is determined whether the optical exposure system 7 has begun to return. After the optical exposure system 7 begins to return, step S18 is executed. In step S18, an original-supply signal is outputted to the ADF control unit 50, in the same manner as in step S7, whereby the ADF 3 exchanges the sheet of original on the contact glass 2 for the next sheet of original. Subsequently, having returned to step S9, the program awaits an original-exchange accomplishment signal from the ADF control unit 50. When an original-exchange accomplishment signal appears, steps S10 to 18 as described above are again executed.

If only one sheet of original remains in the original storing tray 25, the ADF control unit 50 outputs a last-sheet signal to the main control unit 40, as described below. In this case, after the copying processes for the last sheet of original are carried out, the program proceeds from step S15 to step S19, at which the remaining sheet of original located on the contact glass 2 is discharged. Then, the program runs back to step S2.

In this embodiment, the next sheet of recording paper begins to be supplied after the optical exposure system 7 starts moving and before it starts to return, as described with reference to FIG. 3B. Accordingly, the next sheet of recording paper has reached the resist rollers 20 when the exposure system 7 arrives at its home position, whereby time required in conventional apparatuses to awaiting the arrival of the next sheet at the resist rollers 20 is eliminated. This results in high-speed copying operation for a plurality of sheets of original.

Figure 3C:
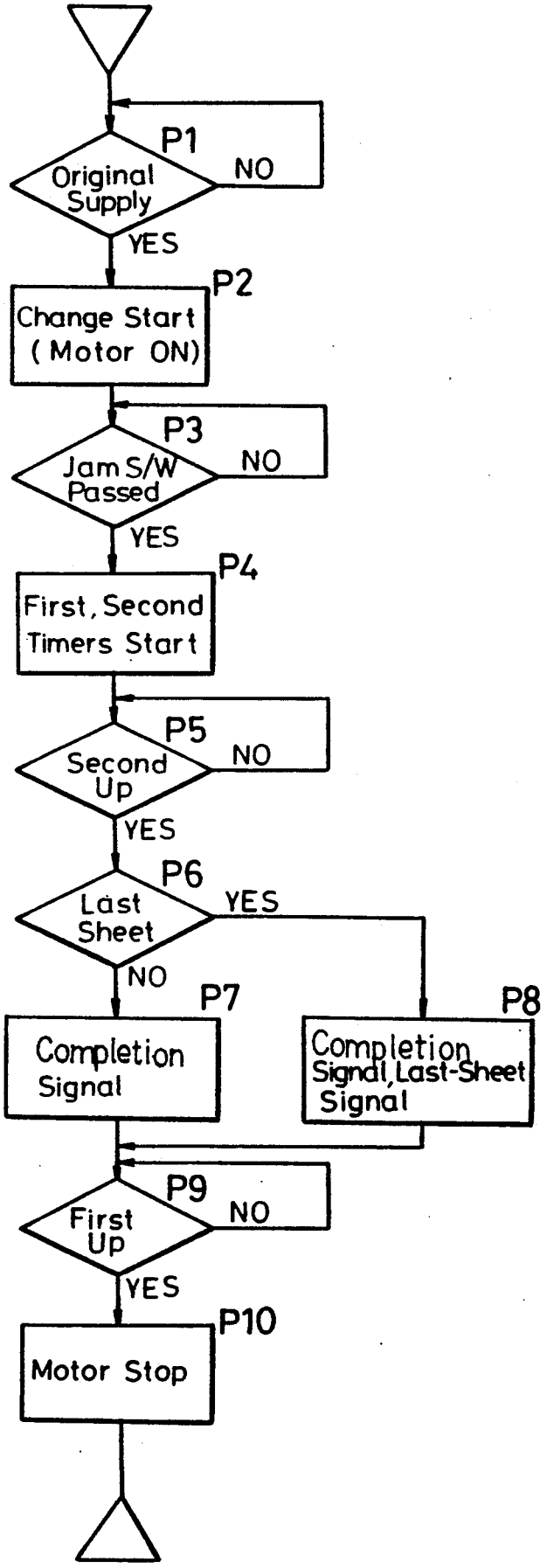

While the main copying machine part 1 is performing, the ADF 3 is controlled as shown in FIG. 3C.

At step P1, the program awaits an original-supply signal from the main control unit 40. When an original-supply signal is inputted to the ADF control unit 50 by the execution of step S7 in FIG. 3A or step S18 in FIG. 3B, step P2 is executed. At step P2, an original-supply operation begins the transport of a sheet of original from the original storing tray 25 to the contact glass 2. Specifically, a driving motor starts rotating to drive the transporting rollers 28, the transportation belt 27 and related members. Thereby, a sheet of original is transported from the original storing tray 25 through the transporting rollers 28 and the resist rollers 31 to the predetermined position between the transportation belt 27 and the contact glass 2.

During the transportation, at step P3, it is determined whether the transported sheet of original has passed the jam detecting switch 32. When the sheet of original has passed the jam detecting switch 32, step P4 is executed whereby the first and second timers 52 and 53 start. At step P5, it is determined whether the second timer 53 has expired. When the second timer 53 has expired, step P6 is executed whereby it is determined whether the transported sheet of original is the last one. This determination is carried out by detecting the ON/OFF condition of the original detecting switch 30. If one or more sheets of original remains in the tray 25, the program runs from step P6 to step P7. At step P7, an original-exchange completion signal is delivered to the main control unit 40. Having received the original-exchange completion signal, the main control unit 40 proceeds from step S9 to the following processes in FIG. 3A. Then, if the transported sheet of original is the last one, step P8 is executed, whereby a last-sheet signal is delivered to the main control unit 40 along with an original-exchange completion signal. Having received the last-sheet signal, the main control unit 40 executes step S19 in FIG. 3B.

At step P9, it is determined whether the first timer 52 has expired. When the first timer 52 expires, step P10 is executed in order to stop the original-sheet transporting motor of the ADF driver 51. Then, the program runs back to step P1 and again awaits an original-supply signal from the main control unit 40.

Figure 4:
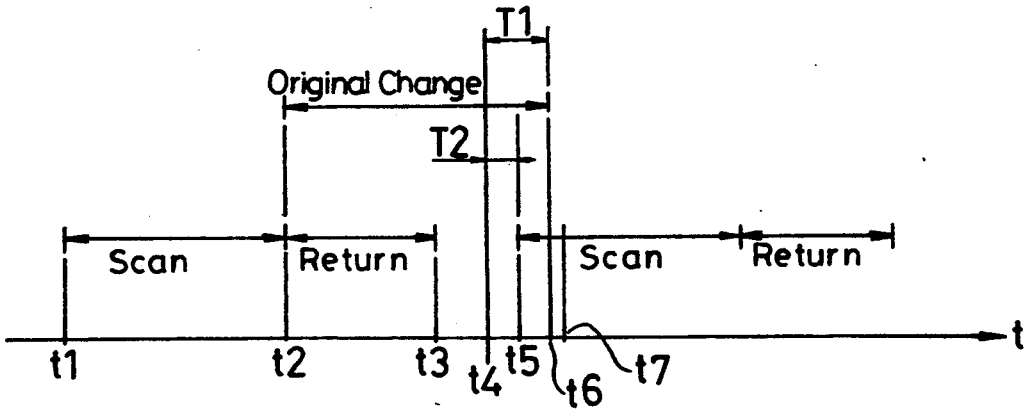
FIG. 4 is a timing chart showing timing of the operations of the embodiment.

The time series for the aforementioned operation is shown in FIG. 4.

Referring to FIG. 4, at time t1, the optical exposure system 7 starts moving. Then, it starts returning at time t2, and arrives at its home position at time t3. At time t2, and ADF 3 starts the original change operation. Then, as the jam detecting switch 32 is turned off at time t4, both timers 52 and 53 start. At time t5, when a predetermined period of time T2 of the second timer 53 expires, the ADF control unit 50 outputs an original-exchange completion signal to the main control unit 40 regardless of whether the exchange of the sheets of original has been completed. Accordingly, the main control unit 40 starts the optical exposure system 7 moving at time t5. In the meantime, the original-sheet exchanging operation is taking place, and after an interval the motors stop, finishing the original-exchange operation at time t6. Just after time t6, the first timer 52 expires at time t7, and the reading of image information from the original, or the actual exposing of the sheet of original, begins.

As described in the above, time t5 when an original-exchange completion signal is delivered is appropriately controlled by the second timer 53, whereby the original-exchange operation finishes at time t6 just prior to time t7 when exposure actually begins. Consequently, only an instant between times t6 and t7 is lost by the period of transition from the original-exchange operation and the exposure operation, so that the copying machine can make copies corresponding to a plurality of sheets of original at higher speed, by comparison to conventional copying machines.

MODIFICATIONS (a) In the above embodiment, whether a next sheet of original exists is determined at the timing when the exposure system 7 starts scanning the former sheet of original, and then the operation to supply the next sheet of recording paper begins. However, the present invention is not limited by the above embodiment, provided that the operation to supply the next sheet of recording paper is begun before the optical exposure system 7 starts to return. For example, the operation to supply the next sheet of recording paper may begin at the timing when the following edge of the former sheet of recording paper passes the resist rollers 20, or when the resist-roller switch 22 is turned off.

(b) In the foregoing embodiment, the wait time for the optical exposure system 7 after the exchange of originals is eliminated, since a sheet of recording paper has reached the resist rollers 20 at the timing when the corresponding sheet of original is positioned on the contact glass 2. However, the present invention may be implemented in such a way that the waiting time is only shortened.

(c) In the forgoing embodiment, the operations for supplying a sheet from the bypass tray 23 and the paper cassette cases 4 and 5 have identical timings as to when the operations start. However, the timings of the operations with regard to the bypass tray 23 and the paper cassette cases 4 and 5 may be different from one another, in correspondence with the distances from the resist rollers 20.

(d) In the foregoing embodiment, the original storing tray 25 and the original receiving part 26 of the ADF 3 are separate from each other. However, the present invention may be embodied using an ADF having an identical part for both the original receiving portion and the original discharging portion, which circulates the sheets of original.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for transporting original sheets which positions an original sheet onto a predetermined portion of a contact glass in an image forming apparatus and discharges the original sheet from the contact glass, comprising:

an original storing part for storing original sheets;

means for transporting original sheets from said original storing part onto said predetermined portion of said contact glass;

means for detecting the passage of an original sheet, provided in said sheet transporting means; and means for outputting a sheet-transportation completion signal to said image forming apparatus after said passage detecting means detects the passage of said original sheet and before said sheet transporting means positions said original sheet on said predetermined portion of said contact glass.

2. An apparatus according to claim 1, wherein said sheet-transportation completion signal outputting means outputs said sheet-transportation completion signal according to timing whereby the period of time between the output of said sheet-transportation completion signal and the positioning of said original sheet is shorter than a period of time defined by when said image forming apparatus receives said sheet-transportation completion signal from said sheet-transportation completion signal outputting means and starting of image-forming operations.

3. An apparatus according to claim 2, wherein said original passage detecting means is a means for judging whether a sheet is jammed.

4. An apparatus according to claim 3, wherein said sheet-transportation completion signal output means includes a first time measuring means which starts at the timing when said original sheet passes said original passage detecting means; and said first time measuring means has a variable expiration time.

5. An apparatus according to claim 4 further comprising a second means for measuring time which begins timing when said original sheet passes said original passage detecting means; wherein said sheet transporting means stops when said second time measuring means expires.

6. An image forming apparatus comprising:

a unit for transporting of originals including means for storing original sheets; means for transporting an original sheet from said storing means; means for detecting the passage of a transported sheet, provided in said transporting means; and means for outputting a sheet-transportation completion signal after said detecting means detects the passage of said original sheet and before said transporting means finishes its operation; and a unit for image forming on the sheet transported by said transporting means including means for performing preparatory operations for image forming upon receipt of said sheet-transportation completion signal; and means for performing an image forming operation after said preparatory operations are completed.

7. An image forming apparatus according to claim 6, wherein said image-forming operation performing means includes means for forming an image on a recording sheet, means for supplying said recording sheet to said image forming means, and an optical exposure system for scanning the original sheet placed onto said contact glass; and said preparatory-operation performing means includes a first determining means for determining whether said recording sheet is located in a predetermined position by said recording sheet supply means, and second determining means for determining whether said optical exposure system is located at its initial position.

8. An apparatus for supplying a recording sheet in an image forming apparatus which has a contact glass, an original transporting part for transporting an original sheet onto said contact glass, an optical exposure system for scanning said original sheet positioned onto said contact glass by reciprocating movement below said contact glass, and an image forming part for forming an image of said original sheet obtained by said optical exposure system on a recording sheet, comprising:

means for judging whether a next original sheet is to be transported to said contact glass;

means for transporting a recording sheet to said image forming part; and means for controlling said transporting means whereby if a next original sheet is judged by said judging means to be present, said transporting means begins to transport a recording sheet corresponding to the next original sheet before said optical exposure system begins to return.

9. An apparatus according to claim 8, wherein said controlling means directs said transporting means to start transporting the recording sheet corresponding to the next original sheet when said controlling means detects that said optical system has started to scan the original.

10. An apparatus according to claim 8, wherein said transporting means includes a transporting roller for transporting a recording sheet; and a resist roller for stopping the recording sheet transported by said transporting roller and transporting said recording sheet toward said image forming part in correspondence with the movement of said optical exposure system.

11. An apparatus according to claim 10, wherein said controlling means directs said transporting means such that said transporting means transports a recording sheet wherein the recording sheet reaches said resist roller before the corresponding original sheet is placed onto a predetermined portion of said contact glass.

12. An apparatus according to claim 10, wherein said controlling means directs said transporting means to start transporting a recording sheet corresponding to the next original sheet when said controlling means detects said resist roller starting to transport a prior recording sheet to said image forming part.

13. An apparatus according to claim 8, wherein said original transporting part includes an original storing part for storing said original sheet, and original detecting means for detecting the original sheet stored in said original storing part; and said determining means determines whether the next original sheet is present according to a signal from said original detecting means.

14. An image forming apparatus comprising:

an original transporting part including means for storing original sheets; means for transporting an original sheet from said storing means; means for detecting the passage of a transported sheet, provided in said original transporting means; and means for outputting a sheet-transportation completion signal after said passage detecting means detects the passage of said original sheet and before said sheet transporting means finishes its operation;

an image forming part including means for performing preparatory operations for image forming upon receipt of said sheet-transportation completion signal; and means for performing an image forming operation after said preparatory operations are completed, having a contact glass of which predetermined portion receives an original sheet transported by said original transporting means, an optical exposure system for scanning the original sheet placed onto said contact glass by reciprocating movement below said contact glass, and an image forming means for forming an image of said original obtained by said optical exposure system on a recording sheet; and a recording sheet supply part including means for determining whether a next original sheet to be transported to said contact glass is present; means for transporting a recording sheet to said image forming part; and means for controlling said transporting means whereby said transporting means begins transporting before said optical exposure system starts to return, if a next sheet of original is present.

* * * * *